US006500524B2

(12) United States Patent
Moriya

(10) Patent No.: US 6,500,524 B2
(45) **Date of Patent: *Dec. 31, 2002**

(54) RECORDING MEDIUM AND INK-JET RECORDING PROCESS

(75) Inventor: Kenichi Moriya, Urayasu (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/145,980

(22) Filed: Sep. 3, 1998

(65) Prior Publication Data

US 2002/0054980 A1 May 9, 2002

(30) Foreign Application Priority Data

Sep. 8, 1997 (JP) ..... 9-257959

(51) Int. Cl.[7] ..... B41M 5/00
(52) U.S. Cl. ..... 428/195
(58) Field of Search ..... 428/195, 500, 428/522

(56) References Cited

U.S. PATENT DOCUMENTS

| | | | | |
|---|---|---|---|---|
| 4,371,582 | A | 2/1983 | Sugiyama et al. | 428/341 |
| 5,733,637 | A | 3/1998 | Moriya et al. | 428/207 |

FOREIGN PATENT DOCUMENTS

| | | |
|---|---|---|
| DE | 31 32 248 A1 | 6/1982 |
| EP | 0 365 307 A2 | 4/1990 |
| EP | 0 545 470 A1 | 6/1993 |
| EP | 0 678 397 A1 | 10/1995 |
| EP | 0 819 546 A1 | 1/1998 |
| JP | 54-59936 | 5/1979 |
| JP | 57-36692 | 2/1982 |
| JP | 58-177390 | 10/1983 |
| JP | 59-20696 | 2/1984 |
| JP | 59-146889 | 8/1984 |
| JP | 59-198186 | 11/1984 |
| JP | 59-198188 | 11/1984 |
| JP | 61-277484 | 12/1986 |
| JP | 62-174184 | 7/1987 |
| JP | 63-115780 | 5/1988 |
| JP | 63-280681 | 11/1988 |
| JP | 7-61113 | 3/1995 |
| JP | 8-108618 | 4/1996 |

*Primary Examiner*—Pamela H. Schwartz
(74) *Attorney, Agent, or Firm*—Fitzpatrick, Cella, Harper & Scinto

(57) ABSTRACT

Disclosed herein is a recording medium comprising a base material and an ink-receiving layer provided on at least one side of the base material, wherein the ink-receiving layer comprises, as essential components, an hydrophilic resin and a cationic compound having both structural units of the formulae (I) and (II)

(I)

and (II)

wherein R1, R2, R4 and R5 are independently each other hydrogen or an alkyl group, R3 is a phenyl, naphthyl, benzyl or phenethyl group, R6 is a linear segment comprising a hydrophilic repeating segment and having 10 to 50 carbon atoms, and X is a halide ion, a sulfate ion, an alkylsulfate ion, an alkylsulfonate ion, an arylsulfonate ion, or an acetate ion, and wherein the cationic compound is used in combination with the hydrophilic resin in a proportion of from 1 to 40 parts by weight per 100 parts by weight of the hydrophilic resin.

16 Claims, 3 Drawing Sheets

RECORDING MEDIUM AND INK-JET RECORDING PROCESS

BACKGROUND OF THE INVENTION

1. Field of the Invention

The present invention relates to a recording medium suitable for use in ink-jet recording and an ink-jet recording process using such a recording medium.

2. Related Background Art

An ink-jet recording system is a recording system in which recording is conducted by generating and ejecting droplets of an ink by one of various ink ejection systems, for example, an electrostatic attraction system, a system using a piezoelectric element to give an ink mechanical vibration or change, or a system in which an ink is heated to form bubbles in the ink, thereby using the pressure thus produced, and applying the whole or a part of the droplets to a recording medium such as paper or a plastic film coated with an ink-receiving layer. The ink-jet recording system attracts attention as a printing method which scarcely produces noise and can conduct high-speed printing and multi-color printing.

As inks used for the ink-jet recording system, inks comprising water as a principal component are mainly used from the viewpoints of safety, printability, etc. Water-soluble organic solvents such as polyhydric alcohols are often added to such inks with a view toward preventing clogging of orifices and improving ejection stability. Therefore, it is required of recording media used in ink-jet recording that images formed thereon by these inks become excellent in water fastness (hereinafter referred to as "the ability to improve the water fastness of images").

Conventionally known recording media for ink-jet recording, which have been proposed for meeting such a requirement, include, for example, a recording sheet described in Japanese Patent Application Laid-Open No. 57-36692, comprising a water-insoluble polymer latex composed of a copolymer with a monomer having a tertiary amino group or quaternary ammonium group, a recording sheet described in Japanese Patent Application Laid-Open No. 58-177390, comprising an electrically-conductive agent of the quaternary ammonium salt type, a recording sheet described in Japanese Patent Application Laid-Open No. 59-20696, comprising a diallyldialkylammonium halide, and a recording sheet described in Japanese Patent Application Laid-Open No. 59-146889, comprising a dicyandiamide-formalin condensate.

Besides, there are described a recording sheet comprising a quaternary cationic or amine compound in Japanese Patent Application Laid-Open No. 61-277484, a recording sheet comprising polyallylamine hydrochloride in Japanese Patent Application Laid-Open No. 62-174184, a recording sheet comprising an organic acid salt of polyethyleneimine in Japanese Patent Application Laid-Open No. 59-198186, a recording sheet comprising a quaternized product of polyethyleneimine in Japanese Patent Application Laid-Open No. 59-198188, a recording sheet comprising a poly (dialkanolallylamine) derivative in Japanese Patent Application Laid-Open No. 63-280681, a recording sheet comprising a polymer based on a (meth)acrylic acid alkyl quaternary ammonium salt or a polymer based on a (meth) acrylamidoalkyl quaternary ammonium salt in Japanese Patent Application Laid-Open No. 63-115780, and a recording medium comprising a polyvinyl acetal resin and a cationic compound as essential components in Japanese Patent Application Laid-Open No. 7-61113.

Furthermore, there is also proposed an additive for ink-jet recording comprising, as an active ingredient, a polymer based on a (meth)acrylic acid alkyl quaternary ammonium salt having a benzyl group or a polymer based on a (meth) acrylamidoalkyl quaternary ammonium salt having a benzyl group in Japanese Patent Application Laid-Open No. 8-108618.

With the improvement in performance of ink-jet recording apparatus, such as speeding up of recording and multi-coloring of images, in recent years, ink-jet recording media have also been required to have higher and wider properties. Particularly, the recording media are strongly required to have the following properties:

(1) being able to stably store an image formed thereon for a long period of time without undergoing changes even when left to stand in a high-temperature and high-humidity environment;

(2) providing a printed image having excellent light fastness;

(3) having high ink absorbency (absorbing capacity being great, and absorbing time being short);

(4) providing dots high in optical density and clear in periphery; and (5) having an ink-receiving layer excellent in water resistance and providing a printed image excellent in water fastness.

In addition to the above properties, such recording media are required to satisfy the following properties at the same time:

(6) being excellent in adhesion between an ink-receiving layer and a base material;

(7) providing dots having a substantially round shape and a smooth periphery when an ink is applied thereto;

(8) undergoing little changes in properties and no curling even at varied temperatures and humidities when they are in the form of a sheet;

(9) undergoing no blocking; and

(10) being stable without undergoing deterioration even when they are stored in themselves for a long period of time (in particular, in a high-temperature and high-humidity environment).

Besides, recording sheets for OHP, and the like are further required to have excellent transparency in themselves in addition to the above requirements. More specifically, not only a film as a base material but also an ink-receiving layer provided thereon is required to have excellent transparency.

Further, when a white base material such as a white film or resin-coated paper is used, an ink-receiving layer provided thereon is also required to have excellent transparency so as not to impair the whiteness and/or the glossy feeling of the base material itself. With respect to glossiness in particular, it is a matter of course that the glossiness of an unprinted portion of the recording medium be high, and it is also necessary for a printed portion to have high glossiness.

These properties are often in a relation of trade-off. It has hence been impossible to satisfy them at the same time by the conventionally known techniques. Especially, with the advancement of generalization of ink-jet techniques, opportunities of printing, storing and posting at various places are increasing. Therefore, discoloration or bleeding of printed images becomes a serious problem upon exposure to temperature, humidity or sunlight.

In order to make the quality of an image obtained by ink-jet recording comparable to a silver salt photograph, there is a demand for development of a recording medium capable of providing an image with brighter colors. However, there are the following various difficult problems that confront such a requirement. For example, the recording sheets comprising a cationic compound proposed in Japanese Patent Application Laid-Open Nos. 57-36692, 58-177390, 59-20696, 59-146889, 61-277484, 62-174184, 59-198186, 59-198188, 63-280681, 63-115780 and 7-61113, which have been mentioned above as the recording media of the prior art, are recognized to have been markedly enhanced in the ability to improve the water fastness of images compared with any recording sheet without an addition of cationic compound when conducting ink-jet recording thereon. However, the recording sheets containing the cationic compound tend to change the hue of an ink-jet printed portion though it somewhat varies according to the kind of a dye in an ink used, so that the hue of the resultant image becomes greatly different from the hue inherent in the dye, or the image becomes a gloomy image having poor brightness. The reason for it is considered to be due to the fact that since the cationic compound is ionically bonded to the dye having an anionic group to form a great polymeric complex, and the aggregating state of the dye hence undergoes a change, so that the light absorption spectrum inherent in the dye varies.

Further, in recording sheets obtained by providing an ink-receiving layer on a support, such as sheets for OHP, the water fastness of images printed thereon is impaired when left to stand in a high-temperature and high-humidity environment (for example, 30° C./80% RH) even if such a cationic compound as proposed in the prior art is used, so that bleeding occurs on the images. Such recording sheets are hence poor in the ability to stably store the image (hereinafter referred to as "shelf storability of image" merely).

With the increase of recording density in ink-jet recording methods in recent years, i.e., increase in shot-in ink quantity, the degree of bleeding of an image when the image is left to stand in a high-temperature and high-humidity environment (for example, 30° C./80% RH) comes to be at an unsatisfactory level under the circumstances though it has heretofore been at a fully satisfactory level.

Further, the recording sheets containing the cationic compound proposed in the prior art provide images markedly poor in light fastness compared with recording sheets containing no cationic compound, and so the necessity of improving the light fastness of the resulting image is pointed out.

When a recording medium for ink-jet is prepared by mixing the additive for ink-jet recording proposed in Japanese Patent Application Laid-Open No. 8-108618 with a hydrophilic resin and applying the mixture to a transparent PET film to form an ink-receiving layer, and ink-jet recording is conducted thereon, an image, which is fully satisfactory in coloristic performance and light fastness, is provided. However, bleeding occurs on such an image when the image is left to stand in a high-temperature and high-humidity environment (for example, 30° C./80% RH), and so the recording medium is not such that the shelf storability of image can be fully satisfied.

SUMMARY OF THE INVENTION

It is accordingly an object of the present invention to provide a recording medium which satisfies the above-described various properties at the same time in a well-balanced relation and is suitable for use in ink-jet recording, and particularly to provide a recording medium which has excellent shelf storability of image in that an image formed thereon undergoes no changes such as bleeding even when it is left to stand for a long period of time under environmental conditions of a high-temperature and a high-humidity after printing, to say nothing of being excellent in the image quality of the image right after printing, and which can provide an image having excellent light fastness though its ink-receiving layer contains a cationic compound, and an ink-jet recording process and an image forming process using such a recording medium.

The above object can be achieved by the present invention described below.

According to the present invention, there is thus provided a recording medium comprising a base material and an ink-receiving layer provided on at least one side of the base material, wherein the ink-receiving layer comprises, as essential components, a hydrophilic resin and a cationic compound having both structural units of the formulae (I) and (II)

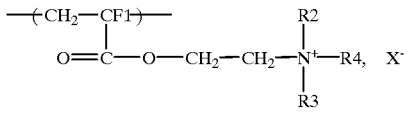

(I)

and

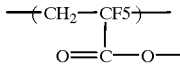

(II)

wherein R1, R2, R4 and R5 are independently each other hydrogen or an alkyl group, R3 is a phenyl, naphthyl, benzyl or phenethyl group, R6 is a linear segment comprising a hydrophilic repeating segment and having 10 to 50 carbon atoms, and X is a halide ion, a sulfate ion, an alkylsulfate ion, an alkylsulfonate ion, an arylsulfonate ion, or an acetate ion, and wherein the cationic compound is used in combination with the hydrophilic resin in a proportion of from 1 to 40 parts by weight per 100 parts by weight of the hydrophilic resin.

According to the present invention, there is also provided an ink-jet recording process comprising the step of ejecting ink droplets from an orifice of a recording head to the recording material mentioned above in accordance with a recording signal.

DESCRIPTION OF THE PREFERRED EMBODIMENTS

Figure 1:
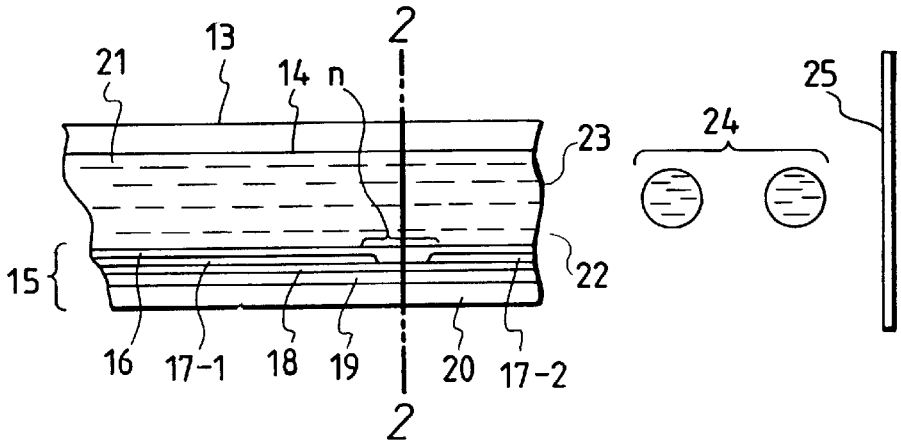
FIG. 1 is a longitudinal cross-sectional view of a head of an ink-jet recording apparatus.

In the course of research and development of recording paper suitable for use in ink-jet recording and a recording medium capable of forming a glossy, photograph-like image, the present inventors have found that a recording medium provided with an ink-receiving layer by coating a base material with a composition having the above-described constitution has the following advantages. Namely, the recording medium is far excellent in performance characteristics such as ink absorbing capacity, ink-fixing ability, resistance to blocking, the ability to improve the water fastness of images and resistance to leaving fingerprints. Further, the recording medium can provide an image clear and sharp in dots and excellent in image quality, undergoes little changes in the performance characteristics even when environmental conditions such as temperatures and humidities vary, and particularly permits the provision of an image, which has excellent image quality right after printing, and at the same time can maintain the excellent image free of bleeding without impairing the ability to improve the water fastness of images even when stored for a long period of time under environmental conditions of a high-temperature and a high-humidity. Even when a transparent base material is used, it is also excellent in transparency of sheet and suitability for OHP. Even when a white base material such as a white film or resin-coated paper is used, no evils of reductions in whiteness and glossiness of the base material due to the provision of the ink-receiving layer are brought, so that high glossiness can be realized at printed portions. In addition, it permits the formation of an excellent image without bringing evils of reductions in light fastness and coloristic performance though the ink-receiving layer contains the cationic compound. The present invention has thus been led to completion.

The recording medium according to the present invention is characterized in that an ink-receiving layer is formed by a composition which comprises, as essential components, a hydrophilic resin and a cationic compound having both the above-described structural units of the formulae (I) and (II), and in which the cationic compound is used in combination with the hydrophilic resin in a proportion of 1 to 40 parts by weight per 100 parts by weight of the hydrophilic resin.

The hydrophilic resin, which is the first compound used in the formation of the ink-receiving layer in the present invention, means a water-soluble resin or water-dispersible resin capable of receiving the so-called water-based inks and showing solubility in or affinity for the water-based inks. A description thereof will hereinafter be given.

As examples of the water-soluble resin, may be mentioned synthetic resins, such as polyvinyl alcohol and modified products thereof such as anionically modified polyvinyl alcohol, cationically modified polyvinyl alcohol and acetal-modified polyvinyl alcohol; hydrophilic polyurethane; polyvinyl pyrrolidone and modified products thereof such as copolymers of polyvinyl pyrrolidone and vinyl acetate, copolymers of vinylpyrrolidone and dimethylaminoethyl methacrylate, copolymers of quaternized vinyl pyrrolidone and dimethylaminoethyl methacrylate and copolymers of vinylpyrrolidone and methacrylamidopropyltrimethylammonium chloride; cellulosic water-soluble resins such as carboxymethyl cellulose, hydroxyethyl cellulose and hydroxypropyl cellulose, and modified products of cellulose such as cationic hydroxyethyl cellulose; polyester, polyacrylic acid (esters), melamine resins and modified products thereof; and graft copolymers comprising polyester and polyurethane; and natural resins such as albumin, gelatin, casein, starch, cationized starch, gum arabic and sodium alginate, to which, however, the present invention is not limited. In the present invention, among these water-soluble resins, polyvinyl alcohol, cationically modified polyvinyl alcohol, acetal-modified polyvinyl alcohol, polyester, hydrophilic polyurethane and graft copolymers comprising polyester and polyurethane are particularly preferred from the viewpoints of coloristic performance and ink absorbency. In the present invention, it is preferred that at least one of these water-soluble resins be selected and contained in the ink-receiving layer.

As examples of the water-dispersible resin, may be mentioned a great number of resins such as polyvinyl acetate, ethylene-vinyl acetate copolymers, polystyrene, styrene-(meth)acrylate copolymers, (meth)acrylate polymers, vinyl acetate-(meth)acrylic acid (ester) copolymers, poly(meth) acrylamide, (meth)acrylamide copolymers, styrene-isoprene copolymers, styrene-butadiene copolymers, ethylene-propylene copolymers, polyvinyl ether and silicone-acrylic copolymers. However, it goes without saying that the present invention is not limited to these resins. Those containing units such as N-methylolacryl-amide and having self-crosslinking ability may be used.

Incidentally, in the present invention, a plurality of the above-mentioned hydrophilic resins may be used at the same time as a component of the ink-receiving layer.

The cationic compound, which is a second compound used in the formation of the ink-receiving layer of the recording medium according to the present invention, is a compound comprising the following structural units of the formulae (I) and (II) as essential components. However, such a cationic compound may further contain other structural units so far as it contains the following structural units of the formulae (I) and (II) as essential components.

As examples of other structural units, may be mentioned units from monomers such as, for example, ethylene, butadiene, styrene, vinyl acetate, (meth)acrylic acid esters, (meth)acrylamide, N-methylol(meth)acrylamide, N,N-dimethyl(meth)acrylamide, (meth)acrylonitrile, (meth) acrylamidoalkylamine, vinylpyridine, 2-hydroxyethyl (meth)acrylate, 2-hydroxypropyl (meth)acrylate, and the like. However, it goes without saying that the present invention is not limited to these structural units. In the present invention, at least one of these structural units may be copolymerized with the cationic compound of the present invention, within limits not impeding the achievement of the objects of the present invention.

(I)

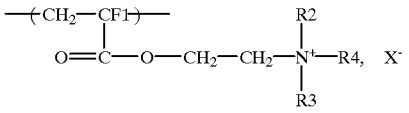

and (II)

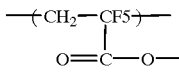

wherein R1, R2, R4 and R5 are independently hydrogen or an alkyl group, R3 is a phenyl, naphthyl, benzyl or phenethyl group, R6 is a linear segment comprising a hydrophilic repeating segment and having 10 to 50 carbon atoms, and X is a halide ion, a sulfate ion, an alkylsulfate ion, an alkylsulfonate ion, an arylsulfonate ion, or an acetate ion.

The alkyl groups represented by R1, R2, R4 and R5 preferably have 1 to 3 carbon atoms. The halide ion represented by X is preferably selected from the group consisting of chloride, bromide and iodide ions.

Of the above-described cationic compounds, those in which R3 in the structural unit of the formula (I) is a benzyl group, and R6 in the structural unit of the formula (II) is a radical of the formula $$—(CH_2CH_2NH)_n—R7$$

or $$—(CH_2CH_2O)_n—R7$$

wherein n is an integer of 4 to 23, and R7 is a hydroxyl, methyl, ethyl, phenyl or benzyl group, are preferred in the present invention.

In the present invention, it is particularly preferred to use a cationic compound in which R6 in the structural unit of the formula (II) is a hydrophilic linear segment having a radical of the formulae $$—(CH_2CH_2O)_n—R7$$

wherein n is an integer of 6 to 12, and R7 is a methyl or phenyl group.

With respect to specific examples of the cationic compounds preferably usable in the present invention, the structural unit of the formula (I) and structural unit of the formula (II) thereof are shown in Table 1 below.

TABLE 1

| | Structural unit (I) | | | | | Structural unit (II) | |
|---|---|---|---|---|---|---|---|
| | R1 | R2 | R3 | R4 | X | R5 | R6 |
| Ex. 1 | H | $CH_3$ | $CH_2$— 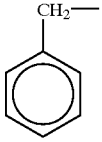 | $CH_3$ | Cl | H | $—(CH_2CH_2O)_9—CH_3$ |
| Ex. 2 | H | $CH_3$ | $CH_2$— 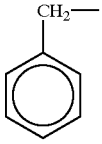 | $CH_3$ | Cl | H | —$(CH_2CH_2O)_6$— 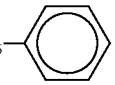 |
| Ex. 3 | $CH_3$ | $CH_3$ | $CH_2$— 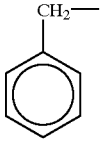 | $CH_3$ | Cl | H | $—(CH_2CH_2O)_9—CH_3$ |
| Ex. 4 | $CH_3$ | $CH_3$ | $CH_2$— 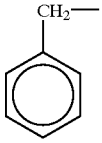 | $CH_3$ | Cl | H | —$(CH_2CH_2O)_6$— 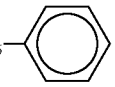 |
| Ex. 5 | H | $CH_3$ | $CH_2$— 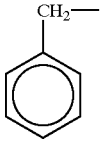 | $CH_3$ | Cl | $CH_3$ | $—(CH_2CH_2O)_9—CH_3$ |
| Ex. 6 | H | $CH_3$ | $CH_2$— 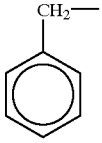 | $CH_3$ | Cl | $CH_3$ | —$(CH_2CH_2O)_6$— 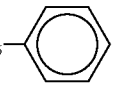 |
| Ex. 7 | $CH_3$ | $CH_3$ | $CH_2$— 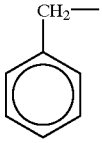 | $CH_3$ | Cl | $CH_3$ | $—(CH_2CH_2O)_9—CH_3$ |

TABLE 1-continued

| | Structural unit (I) | | | | | Structural unit (II) | |
|---|---|---|---|---|---|---|---|
| | R1 | R2 | R3 | R4 | X | R5 | R6 |
| Ex. 8 | $CH_3$ | $CH_3$ | $CH_2$— 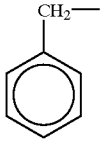 | $CH_3$ | Cl | $CH_3$ | —$(CH_2CH_2O)_6$— 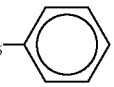 |

The cationic compounds used in the present invention, which have such a structure as described above, are greatly different from the cationic compounds heretofore used as materials for forming ink-receiving layers in the following points:

1) it has a functional group R3 in the structural unit of the formula (I), the quaternized nitrogen atom of which has an aromatic ring; and
2) it has a structural unit of the formula (II) having the linear segment R6 composed of hydrophilic repeating segments which are capable of enhancing affinity for inks.

Since the recording medium according to the present invention uses such a cationic compound as a material for forming the ink-receiving layer, an image formed thereon becomes excellent in all the four properties of image quality, shelf stability of image, light fastness and coloristic performance. The reason for it is not clearly understood. However, first of all, the reason why the image quality is excellent is considered to be due to the fact that since the structural unit of the formula (II) excellent in affinity for water-based inks is contained in the ink-receiving layer, it is hard for the ink-receiving layer to lower its ink absorbency, and so bleeding at boundaries between different colors, and beading are hard to occur. Second, the shelf stability of the image is considered to be improved by the fact that since an anionic compound contained in an ink, such as a water-soluble dye having an anionic group, forms an associated product by an ionic bond with the quaternized cationic moiety in the structural unit of the formula (I), and the aromatic ring in the structural unit of the formula (I) and the linear segment having from 10 to 50 carbon atoms in the structural unit of the formula (II) exist around the associated product, the ink becomes hard to be affected by humidity due to the steric hindrance thereby, so that the dye becomes hard to be dissociated, and bleeding is hence difficult to occur even when the image is stored for a long period of time at a high-temperature and high-humidity environment. Third, the reason why the coloristic performance is not lowered is considered to be attributable to the fact that since the aromatic ring and the linear segment having from 10 to 50 carbon atoms place steric hindrance when the cationic compound is ionically bonded to the cationic compound, a large polymeric complex is hard to be formed, so that the aggregating state of the dye undergoes no change, and the light absorption spectrum inherent in the dye is hence not varied. Therefore, it is avoidable that the hue of the resulting image becomes greatly different from the hue inherent in the dye, or the image becomes a gloomy image having poor brightness.

The composition for forming the ink-receiving layer used in the recording medium according to the present invention comprises in combination such the hydrophilic resin and cationic compound as described above. With respect to the proportions of the hydrophilic resin and the cationic compound to be used in combination, it is preferred that the cationic compound be used in a proportion of from 1 to 40 parts by weight, preferably from 5 to 30 parts by weight, more preferably from 5 to 25 parts by weight, per 100 parts by weight of the hydrophilic resin.

If the proportion of the cationic compound is lower than 1 part by weight per 100 parts by weight of the hydrophilic resin when the composition for forming the ink-receiving layer is prepared by mixing the hydrophilic resin and the cationic compound with each other, the effects of the cationic compound added are not satisfactorily brought about, and a sufficient effect is not achieved in the point of the shelf storability of image in particular. If the proportion of the cationic compound is higher than 40 parts by weight per 100 parts by weight of the hydrophilic resin on the other hand, a sufficient effect is not achieved in the point of the light fastness in particular. In addition, the ink absorbency of the resulting ink-receiving layer is deteriorated, and the resulting recording medium provides an image deteriorated in evenness of a solid printed portion and tends to cause bleeding at boundaries between different colors.

In the present invention, it is preferred that the proportions of the structural units of the formulae (I) and (II) in the cationic compound be within ranges of from 60% by weight to 95% by weight and from 5% by weight to 40% by weight, respectively. It is more preferred that the proportions of the structural units of the formulae (I) and (II) be within ranges of from 70% by weight to 95% by weight and from 5% by weight to 30% by weight, respectively. It is most preferred that the proportions of the structural units of the formulae (I) and (II) be within ranges of from 75% by weight to 95% by weight and from 5% by weight to 25% by weight, respectively.

More specifically, when the cationic compound containing the structural unit of the formula (I) and the structural unit of the formula (II) in such proportions as described above is used, such formation of the associated product from the anionic compound in the ink and the quaternized cationic moiety in the structural unit of the formula (I), moderate existence of the linear segment having excellent affinity in the structural unit of the formula (II), and steric hindrance by the linear segment and the aromatic ring in the structural unit of the formula (I) as described above are developed in a well-balanced state, so that an image excellent in all of image quality, shelf stability, light fastness and coloristic performance can be formed.

The weight average molecular weight of the cationic compound useful in the practice of the present invention is preferably within a range of from 10,000 to 500,000, more preferably from 10,000 to 200,000, most preferably from 10,000 to 100,000. If the weight average molecular weight is lower than 10,000, the film-forming property of the resulting composition becomes low, so that a film formed becomes sticky when the ink-receiving layer is formed therefrom. If the weight average molecular weight is higher than 500,000 on the other hand, no problem arises on the film-forming property of the resulting composition, but the ink absorbency of the composition is deteriorated, which forms the main cause that the ink absorbency of the resulting ink-receiving layer is deteriorated when such a cationic compound is used in combination with the hydrophilic resin to form the ink-receiving layer.

In order to further improve the shelf storability of image, any other cationic compound than the above-described cationic compounds may be additionally contained within limits not impeding the achievement of the object of the present invention. No particular limitation is imposed on such a cationic compound so far as it contains a cationic moiety in its molecule. In the present invention, it goes without saying that other cationic compounds than the cationic compound having the above-described structure are not an essential component and play an auxiliary part persistently.

In the present invention, as a means for adjusting the hydrophilicity of the resulting ink-receiving layer, a crosslinking agent such as methylol melamines, methylol ureas, methylol hydroxypropyleneureas and isocyanates may be further contained in the composition for forming the ink-receiving layer.

In the present invention, various additives may be used in combination in the composition for forming the ink-receiving layer within limits not impeding the achievement of the objects of the present invention. Specific examples of the additives include various kinds of surfactants, various kinds of fillers, dye-fixing agents (water-proofing agents), antifoaming agents, antioxidants, optical whitening agents, ultraviolet absorbents, dispersing agents, viscosity modifiers, pH adjusters, mildew-proofing agents and plasticizers. These additives may be optionally selected from the conventionally-known compounds as necessary for the end application intended. A plurality of these additives may be used at the same time.

The recording medium according to the present invention can be obtained by applying the composition for forming an ink-receiving layer having such constitution as described above on a base material. As the base material used at this time, there may be used a paper web such as wood free paper, medium-quality paper, art paper, bond paper, regenerated paper, baryta paper, cast-coated paper, corrugated fiberboard or resin-coated paper, a film formed of a plastic such as polyethylene terephthalate, acetyl acetate (diacetate), triacetyl acetate, cellophane, celluloid, polycarbonate, polyimide, polyvinyl chloride, polyvinylidene chloride, polyacrylate, polyethylene or polypropylene, a board of wood, a glass plate or sheet, or a fabric of cotton, rayon, acrylic, silk, polyester or the like. It goes without saying that the present invention is not limited to these base materials.

The base material used in the present invention and composed of such a material as described above may have either a smooth surface or an irregular surface, or be either transparent, translucent or opaque. Two or more of these materials may be selected and laminated on each other to be used as the base material. A mat layer, pressure sensitive adhesive release layer or the like may be provided on the opposite side of a printing surface, or a pressure sensitive adhesive layer may be provided on a printing surface after printing. In the present invention, the base material is suitably chosen for use from the above-mentioned materials according to various conditions such as the intended printing application of the resulting recording medium, the use of a printed image and the adhesiveness to the composition for the ink-receiving layer to be coated thereon.

Upon the production of the recording medium according to the present invention, the hydrophilic resin and the cationic compound having the structural units of the formulae (I) and (II) are first dissolved or dispersed, together with other additives if necessary, in water, an alcohol, a polyhydric alcohol or another suitable organic solvent to prepare a coating formulation.

The coating formulation thus obtained is then applied to the surface of a proper base material by, for example, a roll coater, blade coater, air knife coater, gate roll coater, bar coater, size pressing, spray coating, gravure coater or curtain coater process. Thereafter, the thus-coated base material is dried using, for example, a hot-air drying oven or heated drum, thereby obtaining a recording medium according to the present invention. As needed, the recording medium thus obtained may be further subjected to supercalendering or the like for the purpose of enhancing the smoothness or surface strength of the ink-receiving layer.

A coating weight upon the formation of the ink-receiving layer is preferably within a range of from 0.2 to 50 $g/m^2$, more preferably from 1 to 30 $g/m^2$ in total. If the coating weight is less than 0.2 $g/m^2$, no sufficient effects are brought about from the viewpoints of the coloristic performance of dyes, ink-absorbing capacity and ink-fixing ability compared with the case where no ink-receiving layer is provided. If the coating weight exceeds 50 $g/m^2$ on the other hand, curling occurs to a marked extent in the resulting recording medium, particularly, under environmental conditions of a low-temperature and a low-humidity. The coating weight may preferably be within a range of from 0.5 to 50 $\mu$m in terms of thickness.

As inks used at the time an image is formed on the recording medium described above, conventionally-known water-based inks may be used. In the present invention, it is particularly preferred that inks containing an anionic compound such as a water-soluble dye having an anionic group therein be used. Examples of the water-soluble dye used at this time include water-soluble direct dyes, acid dyes, basic dyes and reactive dyes which have each an anionic group such as sulfonic acid group or carboxyl group. In addition, disperse dyes and pigments may be used. In such a case, however, it is preferred that they be used in combination with an anionic compound. These water-soluble dyes, or disperse dyes or pigments are generally used in a proportion of 0.1 to 20% by weight in the conventional inks. In the present invention as well, they may be used in such a proportion.

A solvent suitable for use in water-based inks used in the present invention is water or a mixed solvent of water and a water-soluble organic solvent. A mixed solvent composed of water and a water-soluble organic solvent and containing, as the water-soluble organic solvent, a polyhydric alcohol having an effect of preventing the drying of the ink is particularly preferred.

A preferred method for forming an image by applying the above-described inks to the recording medium according to the present invention is an ink-jet recording method. As such an ink-jet recording method, any system may be used so far as it can effectively eject an ink from an orifice to apply the ink to the recording medium. In particular, an ink-jet system described in Japanese Patent Application Laid-Open No. 54-59936, in which an ink undergoes a rapid volumetric change by an action of thermal energy applied to the ink, so that the ink is ejected from an orifice by the working force generated by this change of state, may be used effectively in the present invention.

Figure 2:
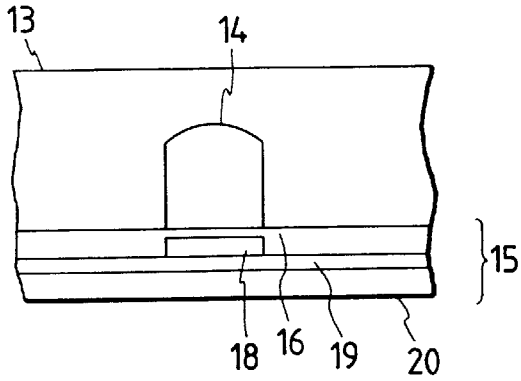
FIG. 2 is a transverse cross-sectional view of the head of the ink-jet recording apparatus.
Figure 3:
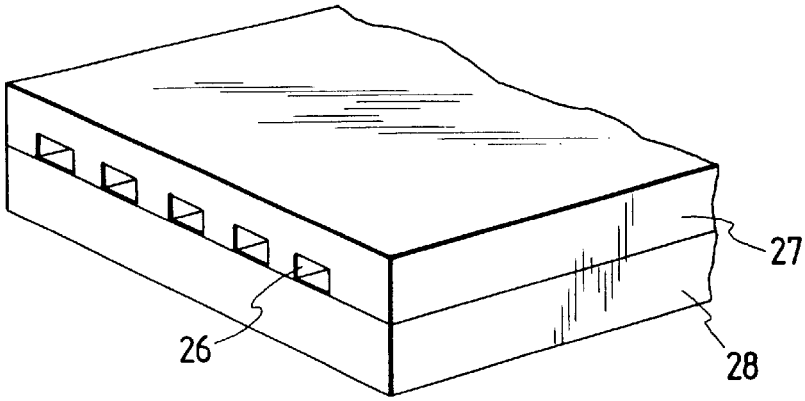
FIG. 3 is a perspective view of the appearance of a multi-head which is an array of such heads as shown in FIG. 1.

An example of an ink-jet recording apparatus suitable for use in applying an ink to the recording medium according to the present invention to conduct recording will hereinafter be described. Examples of the construction of a recording head, which is a main component of such an apparatus, are illustrated in FIGS. 1, 2 and 3.

A head 13 is obtained by bonding a glass, ceramic or plastic plate or the like having a groove 14 through which an ink is passed, to a heating head 15 used for thermal recording (the drawings show a thin-film head to which, however, the invention is not limited). The heating head 15 is composed of a protective film 16 made of silicon oxide or the like, aluminum electrodes 17-1 and 17-2, a heating resistor layer 18 made of nichrome or the like, a heat accumulating layer 19, and a substrate 20 made of alumina or the like having a good heat radiating property.

An ink 21 comes up to an ejection orifice (a minute opening) 22 and forms a meniscus 23 due to a pressure not illustrated.

Now, upon application of electric signals to the electrodes 17-1 and 17-2, the heating head 15 rapidly generates heat at the region shown by n to form bubbles in the ink 21 which is in contact with this region. The meniscus 23 of the ink is projected by the pressure thus produced, and the ink 21 is ejected from the ejection orifice 22 to a recording medium 25 in the form of minute droplets 24.

FIG. 3 illustrates an appearance of a multi-head composed of an array of a number of heads as shown in FIG. 1. The multi-head is formed by closely bonding a glass plate 27 having a number of grooves 26 to a heating head 28 similar to the head as illustrated in FIG. 1.

Incidentally, FIG. 1 is a cross-sectional view of the head 13 taken along the flow path of the ink, and FIG. 2 is a cross-sectional view taken along line 2—2 in FIG. 1.

Figure 4:
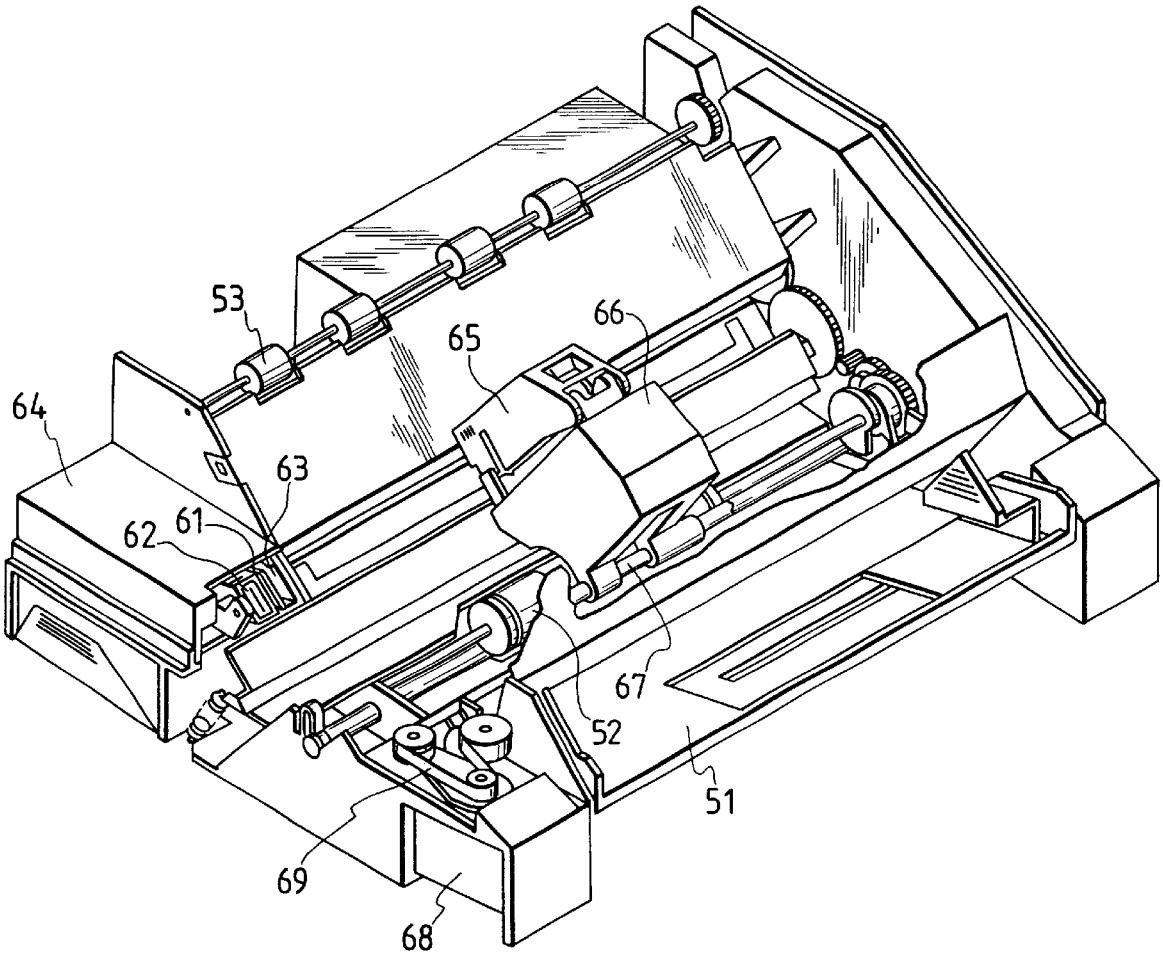
FIG. 4 is a perspective view illustrating an exemplary ink-jet recording apparatus.

FIG. 4 illustrates an example of an ink-jet recording apparatus in which the above head has been incorporated.

In FIG. 4, reference numeral 61 designates a blade serving as a wiping member, one end of which is a stationary end held by a blade-holding member to form a cantilever. The blade 61 is provided at a position adjacent to a region in which a recording head 65 operates, and in this embodiment, is held in such a form that it protrudes into the course through which the recording head 65 is moved.

Reference numeral 62 indicates a cap for a face of ejection openings of the recording head 65, which is provided at a home position adjacent to the blade 61, and is so constructed that it moves in a direction perpendicular to a direction in which the recording head 65 is moved, and comes into contact with the face of ejection openings to cap it. Reference numeral 63 denotes an ink-absorbing member provided adjoiningly to the blade 61 and, similar to the blade 61, held in such a form that it protrudes into the course through which the recording head 65 is moved.

The above-described blade 61, cap 62 and ink-absorbing member 63 constitute an ejection-recovery portion 64, where the blade 61 and ink-absorbing member 63 remove water, dust and/or the like from the face of the ink-ejecting openings.

Reference numeral 65 designates the recording head having an ejection-energy-generating means and serving to eject the ink onto a recording medium set in an opposing relation to the ejection opening face provided with the ejection openings to conduct recording. Reference numeral 66 indicates a carriage on which the recording head 65 is mounted so that the recording head 65 can be moved.

The carriage 66 is slidably interlocked with a guide rod 67 and is connected (not illustrated) at its part to a belt 69 driven by a motor 68. Thus, the carriage 66 can be moved along the guide rod 67 and hence, the recording head 65 can be moved from a recording region to a region adjacent thereto.

Reference numerals 51 and 52 denote a feeding part from which the recording media are separately inserted, and feed rollers driven by a motor (not illustrated), respectively. With such a construction, the recording medium is fed to the position opposite to the ejection opening face of the recording head 65, and discharged from a discharge section provided with discharge rollers 53 with the progress of recording.

In the above construction, the cap 62 in the head recovery portion 64 is receded from the path of motion of the recording head 65 when the recording head 65 is returned to its home position, for example, after completion of recording, and the blade 61 remains protruded into the path of motion. As a result, the ejection opening face of the recording head 65 is wiped. When the cap 62 comes into contact with the ejection opening face of the recording head 65 to cap it, the cap 62 is moved so as to protrude into the path of motion of the recording head 65.

When the recording head 65 is moved from its home position to the position at which recording is started, the cap 62 and the blade 61 are at the same positions as the positions for the wiping as described above. As a result, the ejection opening face of the recording head 65 is also wiped at the time of this movement.

The above movement of the recording head 65 to its home position is made not only when the recording is completed or the recording head 65 is recovered for ejection, but also when the recording head 65 is moved between recording regions for the purpose of recording, during which it is moved to the home position adjacent to each recording region at given intervals, where the ejection opening face is wiped in accordance with this movement.

Figure 5:
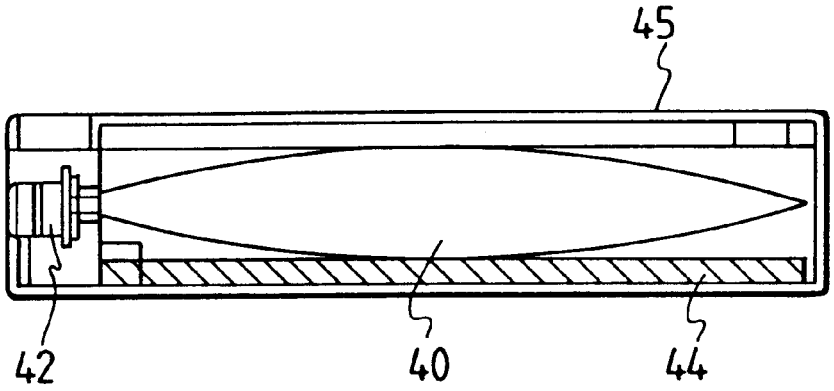
FIG. 5 is a longitudinal cross-sectional view of an ink cartridge.

FIG. 5 illustrates an exemplary ink cartridge 45 in which an ink to be fed to the head through an ink-feeding member, for example, a tube is contained.

Here, reference numeral 40 designates an ink container portion containing the ink to be fed, as exemplified by a bag for the ink. One end thereof is provided with a stopper 42 made of rubber. A needle (not illustrated) may be inserted into this stopper 42 so that the ink in the bag 40 for the ink can be fed to the head. Reference numeral 44 indicates an ink-absorbing member for receiving a waste ink.

It is preferred that the ink container portion be formed of a polyolefin, in particular, polyethylene, at its surface with which the ink comes into contact.

The ink-jet recording apparatus used in the present invention are not limited to the apparatus as described above in which the head and the ink cartridge are separately provided. Therefore, a device in which these members are integrally formed as shown in FIG. 6 can also be preferably used.

Figure 6:
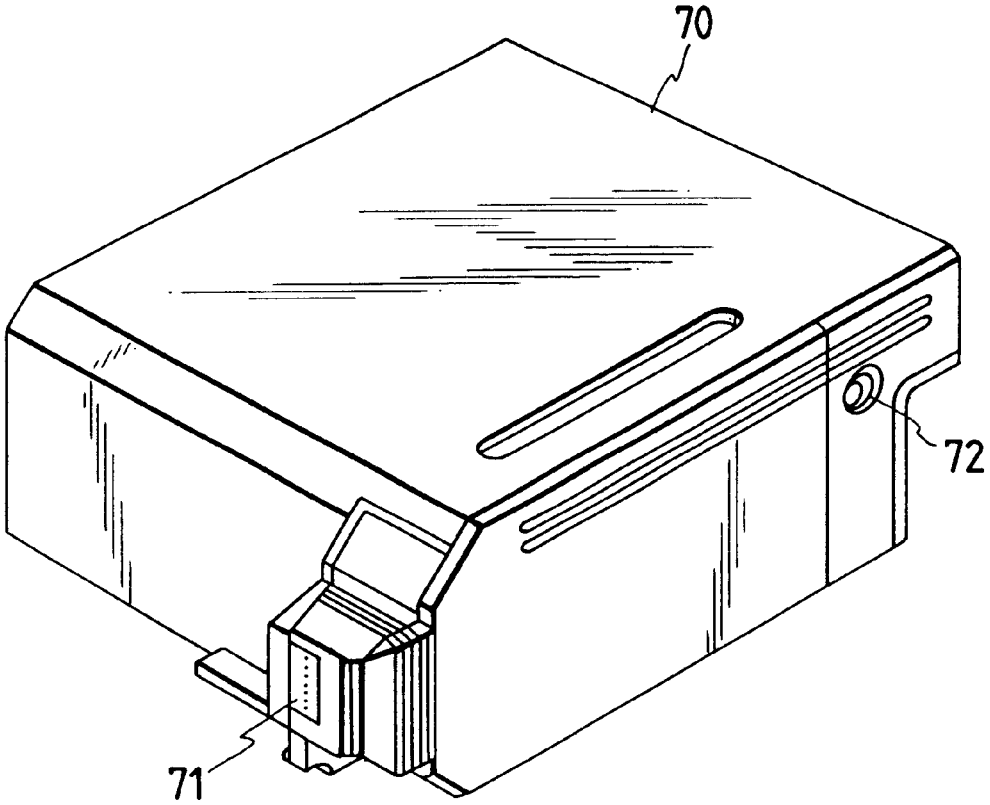
FIG. 6 is a perspective view illustrating an exemplary recording unit.

In FIG. 6, reference numeral 70 designates a recording unit, in the interior of which an ink container portion containing an ink, for example, an ink-absorbing member, is contained. The recording unit 70 is so constructed that the ink in such an ink-absorbing member is ejected in the form of ink droplets through a head 71 having a plurality of orifices.

In the present invention, polyurethane, cellulose or polyvinyl acetal is preferably used as a material for the ink-absorbing member. Reference numeral 72 indicates an air passage for communicating the interior of the recording unit 70 with the atmosphere. This recording unit 70 can be used in place of the recording head 65 shown in FIG. 4, and is detachably installed on the carriage 66.

The present invention will hereinafter be described in more detail by the following Examples and Comparative Examples. However, the present invention is not limited to these examples. Incidentally, all designations of "part" or "parts" and "%" as will be used in the following examples mean part or parts by weight and % by weight unless expressly noted.

The constitution of cationic compounds (a) to (c) used in Examples and Comparative Examples is shown below. These compounds were synthesized in accordance with the conventionally-known method.

Cationic Compound (a):

A compound which is composed of 90% of the structural unit of the formula (I-1) and 10% of the structural unit of the formula (II-1) and has a weight average molecular weight of 40,000.

Cationic Compound (b):

A compound which is composed of 90% of the structural unit of the formula (I-1) and 10% of the structural unit of the formula (II-2) and has a weight average molecular weight of 40,000.

Cationic Compound (c):

A compound which is composed of 90% of the structural unit of the formula (I-1) and 10% of the structural unit of the formula (III) and has a weight average molecular weight of 40,000.

(I-1)

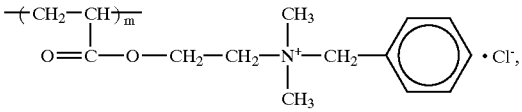

(II-1)

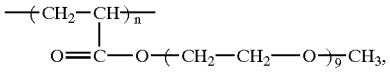

(II-2)

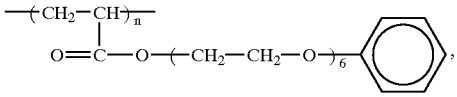

and (III)

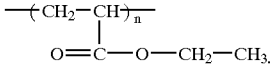

EXAMPLE 1

A composition (coating formulation) for forming an ink-receiving layer was obtained by mixing 100 parts of polyvinyl alcohol (PVA 217, trade name, product of Kuraray Co., Ltd.; polymerization degree: 1,700; saponification degree: about 88 mol %) as a hydrophlic resin and 10 parts of the cationic compound (a) above. The thus-obtained coating formulation was applied to one side of resin-coated paper (RC Gloria Manila, trade name, product of Gojo Seishi K.K.) by means of a wire bar so as to give a dry coating thickness of 10 $\mu$m. The paper thus coated was then dried at 100° C. for 3 minutes to prepare a recording medium provided with an ink-receiving layer.

EXAMPLE 2

A recording medium provided with an ink-receiving layer was prepared in the same manner as in Example 1 except that the polyvinyl alcohol used in Example 1 was changed to cationically modified polyvinyl alcohol (CM-318, trade name, product of Kuraray Co., Ltd.; polymerization degree: 1,700; saponification degree: about 88 mol %).

EXAMPLE 3

A recording medium provided with an ink-receiving layer was prepared in the same manner as in Example 1 except that the polyvinyl alcohol used in Example 1 was changed to acetal-modified polyvinyl alcohol (KW-1, trade name, product of Sekisui Chemical Co., Ltd.).

EXAMPLE 4

A recording medium provided with an ink-receiving layer was prepared in the same manner as in Example 1 except that the polyvinyl alcohol used in Example 1 was changed to a mixture of 50 parts of a hydrophilic urethane resin (Hydrane HM-940, trade name, product of Dainippon Ink & Chemicals Incorporated) and 50 parts of polyvinyl alcohol (PVA 217, trade name, product of Kuraray Co., Ltd.; polymerization degree: 1,700; saponification degree: about 88 mol %).

EXAMPLE 5

A recording medium provided with an ink-receiving layer was prepared in the same manner as in Example 1 except that, to 100 parts of the polyvinyl alcohol, 20 parts of the cationic compound (a) was used.

EXAMPLE 6

A recording medium provided with an ink-receiving layer was prepared in the same manner as in Example 1 except that, to 100 parts of the polyvinyl alcohol, 30 parts of the cationic compound (a) was used.

EXAMPLE 7

A recording medium provided with an ink-receiving layer was prepared in the same manner as in Example 1 except that, to 100 parts of the polyvinyl alcohol, 5 parts of the cationic compound (a) was used.

EXAMPLE 8

A recording medium provided with an ink-receiving layer was prepared in the same manner as in Example 1 except that the base material used in Example 1 was changed to a transparent PET film (Melinex 535, trade name, product of ICI, Ltd.; thickness: 100 $\mu$m).

EXAMPLE 9

A recording medium provided with an ink-receiving layer was prepared in the same manner as in Example 1 except that the cationic compound (a) used in Example 1 was changed to the cationic compound (b).

COMPARATIVE EXAMPLE 1

A recording medium provided with an ink-receiving layer was prepared in the same manner as in Example 1 except that the ink-receiving layer was formed by polyvinyl alcohol (PVA 217, trade name, product of Kuraray Co., Ltd.; polymerization degree: 1,700; saponification degree: about 88 mole %) alone without using the cationic compound (a) used in Example 1.

COMPARATIVE EXAMPLE 2

A recording medium provided with an ink-receiving layer was prepared in the same manner as in Example 1 except that, to 100 parts of the polyvinyl alcohol, 0.5 parts of the cationic compound (a) was used.

COMPARATIVE EXAMPLE 3

A recording medium provided with an ink-receiving layer was prepared in the same manner as in Example 1 except that, to 100 parts of the polyvinyl alcohol, 50 parts of the cationic compound (a) was used.

COMPARATIVE EXAMPLE 4

A recording medium provided with an ink-receiving layer was prepared in the same manner as in Example 1 except that the cationic compound (a) used in Example 1 was changed to the cationic compound (c).

COMPARATIVE EXAMPLE 5

A recording medium provided with an ink-receiving layer was prepared in the same manner as in Example 1 except that the cationic compound (a) used in Example 1 was changed to polyallylamine hydrochloride (PAA-HCl-10L, trade name, product of Nitto Boseki Co., Ltd.).

The constitutions of compositions for forming the ink-receiving layers of Examples 1 to 9 and Comparative Examples 1 to 5 are shown collectively in Table 2.

TABLE 2

Constitution of compositions for ink-receiving layers

| | Hydrophilic resin (parts) | Cationic compound | Hydrophilic resin: Cationic compound |
|---|---|---|---|
| Ex. 1 | Polyvinyl alcohol (100) | (a) | 100:10 |
| Ex. 2 | Cationically modified polyvinyl alcohol (100) | (a) | 100:10 |
| Ex. 3 | Acetal-modified polyvinyl alcohol (100) | (a) | 100:10 |
| Ex. 4 | Hydrophilic urethane resin (50) + polyvinyl alcohol (50) | (a) | 100:10 |
| Ex. 5 | Polyvinyl alcohol (100) | (a) | 100:20 |
| Ex. 6 | Polyvinyl alcohol (100) | (a) | 100:30 |
| Ex. 7 | Polyvinyl alcohol (100) | (a) | 100:5 |
| Ex. 8 | Polyvinyl alcohol (100) (base material: transparent PET film) | (a) | 100:10 |
| Ex. 9 | Polyvinyl alcohol (100) | (b) | 100:10 |
| Comp Ex. 1 | Polyvinyl alcohol (100) | Not used | 100:0 |
| Comp. Ex. 2 | Polyvinyl alcohol (100) | (a) | 100:0.5 |
| Comp. Ex. 3 | Polyvinyl alcohol (100) | (a) | 100:50 |
| Comp. Ex. 4 | Polyvinyl alcohol (100) | (c) | 100:10 |
| Comp. Ex. 5 | Polyvinyl alcohol (100) | Polyallyl-amine hydro-chloride | 100:10 |

[Recording]

Using inks having their corresponding compositions described below, color printing was conducted on the above-obtained recording media of Examples 1 to 9 and Comparative Examples 1 to 5 under the following conditions by means of an ink-jet recording apparatus of a bubble jet system that an ink is ejected by bubbling of the ink by thermal energy.

[Compositions of Inks]

Black ink:

| | |
|---|---|
| C.I. Direct Black 19 | 3 parts |
| Glycerol | 6 parts |
| Ethylene glycol | 5 parts |
| Isopropyl alcohol | 3 parts |
| Urea | 5 parts |
| Water | 78 parts. |

A surface tension of this ink was about 45 dyn/cm.

Yellow, magenta and cyan inks:

Dye 4 parts

Yellow: C.I. Direct Yellow 86

Cyan: C.I. Direct Blue 199

Magenta: C.I. Acid Red 23

| | |
|---|---|
| Glycerol | 7 parts |
| Thiodiglycol | 7 parts |
| Urea | 7 parts |
| Acetylene glycol | 1.5 parts |
| Water | 73.5 parts. |

Surface tensions of these inks were each about 35 dyn/cm.

[Printing Conditions]

Ejection frequency: 6.25 kHz

Volume of ejection droplet: 40 pl

Recording density:

720 dpi (main scanning direction)

360 dpi (secondary scanning direction)

Maximum application volume of a single color ink:

14 nl/mm$^2$

Feeding system: ASF (auto sheet feeder).

[Evaluation]

The recording media of Examples 1 to 9 and Comparative Examples 1 to 5, on which color printing had been conducted in the above-described manner, were evaluated as to the following items in accordance with the following respective evaluation methods. The results of the evaluation are shown in Table 3.

The evaluation of the recording medium of Example 8 using the transparent base material was conducted by means of an image obtained by projecting an image formed on the recording medium by a transmission type projector M4000 (trade name, manufactured by Sumitomo 3M Limited).

(1) Image Quality:

Each of the print samples obtained was visually evaluated as to two items of evenness of a solid printed portion and bleeding at boundaries between different colors. A lateral-striped pattern (2 cm×15 cm for each stripe) for each of black, cyan, magenta, yellow, red, green and blue colors was formed as an image for evaluation and used in the evaluation. The image quality was ranked as A where color irregularity such as beading did not occurred, evenness of the solid printed portions was excellent, and no bleeding occurred at boundaries between different colors, C where color irregularity such as beading occurred, evenness of the solid printed portions was poor, and bleeding occurred at boundaries between different colors, so that image quality was remarkably poor, or B where it was at in-between level.

(2) Coloristic Performance:

Evaluation was visually conducted. Square solid prints (each 3 cm×3 cm) of black, cyan, magenta, yellow, red, green and blue colors were formed as an image for evaluation and used in the evaluation. The coloristic performance was ranked as A where coloring was not different from that of an image formed on an ink-receiving layer without addition of a cationic compound, C where coloring was remarkably different, or B where it was at in-between level.

(3) Shelf Storability of Image:

After printing was conducted on each recording medium sample by means of the above-described printer, and the printed image thus obtained was stored for 7 days under environmental conditions of 30° C./80% RH, the shelf storability of image was evaluated in comparison with the image before the storage. Square patterns (each 3 cm×3 cm) of black, cyan, magenta, yellow, red, green and blue colors, on which white off-print lines of 0.3 mm width were formed, were used for the evaluation. The shelf storability of image was ranked as C where ink running and exudation occurred, so that image quality was remarkably poor compared with the image before the storage, AA where no change was recognized compared with the image before the storage, A where ink exudation somewhat occurred, or B where it was at in-between level.

(4) Light Fastness:

Each print sample was exposed for 30 hours to light from a xenon lamp in an Atlas Fade-o-meter (trade name; manufactured by Toyo Seiki Seisakusho, Ltd.) to compare the exposed sample with the sample before the exposure. The optical densities of images of black, cyan, magenta and yellow colors were measured before and after the test to determine a proportion (percent retention) of the optical density of image after the test to the optical density of image before the test. Square solid prints (each 3 cm×3 cm) of black, cyan, magenta and yellow colors were printed as an image for evaluation and used in the evaluation. The light fastness was ranked as C where the percent retention was lower than 50% even on one color, A where the percent retention of each color was not lower than 80%, or B where it was at in-between level.

TABLE 3

| | Results of evaluation | | | | |
|---|---|---|---|---|---|
| | Image quality | | | Shelf | |
| | Evenness of solid print | Bleeding between different colors | Coloristic performance | stora-bility of image | Light fastness |
| Ex. 1 | A | A | A | AA | A |
| Ex. 2 | A | A | A | A | A |
| Ex. 3 | A | A | A | AA | A |
| Ex. 4 | A | A | A | A | A |
| Ex. 5 | A | A | A | AA | A |
| Ex. 6 | A | A | A | AA | A |
| Ex. 7 | A | A | A | A | A |
| Ex. 8 | A | A | A | AA | A |
| Ex. 9 | A | A | A | AA | A |
| Comp. Ex. 1 | A | A | A | C | A |
| Comp. Ex. 2 | A | A | A | C | A |
| Comp. Ex. 3 | C | C | C | A | C |

TABLE 3-continued

| | Results of evaluation | | | | |
|---|---|---|---|---|---|
| | Image quality | | | Shelf | |
| | Evenness of solid print | Bleeding between different colors | Coloristic performance | stora-bility of image | Light fastness |
| Comp. Ex. 4 | A | A | A | C | B |
| Comp. Ex. 5 | A | A | C–B | C | B |

According to the present invention, as described above, there can be provided recording media satisfying ideal performance requirements that ink absorbency is excellent, a high-definition image high in optical density can be formed, shelf storability of image is excellent in that images formed thereon cause no bleeding and are not deteriorated even when left to stand for a long period of time, particularly, under environmental conditions of a high-temperature and a high-humidity, and images having excellent light fastness can be provided though their ink-receiving layers contain a cationic compound.

What is claimed is:

1. A recording medium comprising a base material and an ink-receiving layer provided on at least one side of the base material, wherein the ink-receiving layer comprises a hydrophilic resin and a cationic compound having both structural units of the formulae (I) and (II)

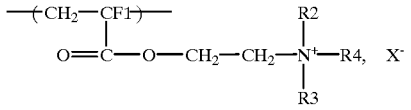

(I)

and

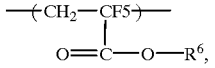

(II)

wherein R1, R2, R4 and R5 are, independently of each other, hydrogen or an alkyl group, R3 is a phenyl, naphthyl, benzyl or phenethyl group, R6 is a linear segment comprising a hydrophilic repeating segment and having 10 to 50 carbon atoms, and X is a halide ion, a sulfate ion, an alkylsulfate ion, an alkylsulfonate ion, an arylsulfonate ion, or an acetate ion, and wherein the cationic compound is used in combination with the hydrophilic resin in a proportion of from 1 to 40 parts by weight per 100 parts by weight of the hydrophilic resin.

2. The recording medium according to claim 1, wherein the proportion of the structural unit of the formula (I) in the cationic compound is within a range of from 60% by weight to 95% by weight and the proportion of the structural unit of the formula (II) in the cationic compound is within a range of from 5% by weight to 40% by weight.

3. The recording medium according to claim 1, wherein the proportion of the structural unit of the formula (I) in the cationic compound is within a range of from 70% by weight to 95% by weight and the proportion of the structural unit of the formula (II) in the cationic compound is within a range of from 5% by weight to 30% by weight.

4. The recording medium according to claim 1, wherein the proportion of the structural unit of the formula (I) in the cationic compound is within a range of from 75% by weight to 95% by weight and the proportion of the structural unit of the formula (II) in the cationic compound is within a range of from 5% by weight to 25% by weight.

5. The recording medium according to claim 1, wherein R3 in the structural unit of the formula (I) is a benzyl group, and R6 in the structural unit of the formula (II) is a radical of the formula $$—(CH_2CH_2NH)_n—R7$$

or $$—(CH_2CH_2O)_n—R7$$

in which n is an integer of 4 to 23, and R7 is a hydroxyl, methyl, ethyl, phenyl or benzyl group.

6. The recording medium according to claim 1, wherein the weight average molecular weight of the cationic compound is within a range of from 10,000 to 500,000.

7. The recording medium according to claim 1, wherein the weight average molecular weight of the cationic compound is within a range of from 10,000 to 200,000.

8. The recording medium according to claim 1, wherein the weight average molecular weight of the cationic compound is within a range of from 10,000 to 100,000.

9. The recording medium according to claim 1, wherein the ink receiving layer comprises a hydrophilic resin selected from the group consisting of polyvinyl alcohol and modified products thereof, hydrophilic polyurethane, polyvinyl pyrrolidone and modified products thereof, cellulosic resins and modified products thereof, polyester, and graft copolymers comprising polyester and polyurethane.

10. The recording medium according to claim 1, wherein the cationic compound is used in a proportion of from 5 to 30 parts by weight per 100 parts by weight of the hydrophilic resin.

11. The recording medium according to claim 1, wherein the cationic compound is used in a proportion of from 5 to 25 parts by weight per 100 parts by weight of the hydrophilic resin.

12. The recording medium according to claim 1, wherein the base material is a plastic film or a resin-coated paper.

13. An ink-jet recording process comprising the step of ejecting ink droplets from an orifice of a recording head to the recording material according to any one of claims 1 to 12 in accordance with a recording signal.

14. The ink-jet recording process according to claim 13 wherein the liquid medium of the ink comprises water and a water-soluble organic solvent.

15. The ink-jet recording process according to claim 13 wherein the ink is any one of a cyan ink, a magenta ink, a yellow ink and a black ink.

16. The ink-jet recording process according to claim 13 wherein the ink is ejected due to heat energy.

* * * * *

UNITED STATES PATENT AND TRADEMARK OFFICE

CERTIFICATE OF CORRECTION

PATENT NO. : 6,500,524 B2 
DATED : December 31, 2002
INVENTOR(S) : Kenichi Moriya It is certified that error appears in the above-identified patent and that said Letters Patent is hereby corrected as shown below:

Title page,
"*Primary Examiner*", "Pamela H. Schwartz" should read -- Pamela R. Schwartz --.
Item [57], ABSTRACT,
Line 4, "an" should read -- a --.

Line 8, "—CF1)—" should read -- —CR1)— --.

Line 13, "—CF5)—" should read -- —CR5)— --.

Line 14, "—$R^6$," should read -- —R6, --.
Line 15, "are" should read -- are, --; and "each other" should read -- of each other, --.

Column 4,
Line 22, "—CF1)—" should read -- —CR1)— --.

Line 29, "—CF5)—" should read -- —CR5)— --.

Line 31, "—$R^6$," should read -- —R6, --.
Line 33, "are" should read -- are, --; and "each other" should read -- of each other, --.

Column 6,
Line 47, "—CF1)—" should read -- —CR1)— --.

Line 53, "—CF5)—" should read -- —CR5)— --.

Line 55, "—$R^6$," should read -- —R6, --.

Column 13,
Line 20, "pressure" should read -- pressure, --.

Column 18,
Line 61, "occurred," should read -- occur, --.

Column 20,
Line 34, "—CF1)—" should read -- —CR1)— --.

Line 40, "—CF5)—" should read -- —CR5)— --.

Line 41, "—$R^6$," should read -- —R6, --.

UNITED STATES PATENT AND TRADEMARK OFFICE

CERTIFICATE OF CORRECTION

PATENT NO. : 6,500,524 B2 
DATED : December 31, 2002
INVENTOR(S) : Kenichi Moriya It is certified that error appears in the above-identified patent and that said Letters Patent is hereby corrected as shown below:

Column 22,
Line 17, "material" should read -- medium --.
Lines 19, 22 and 25, "claim 13" should read -- claim 13, --.

Signed and Sealed this

Eighteenth Day of November, 2003

JAMES E. ROGAN
*Director of the United States Patent and Trademark Office*